United States Patent [19]

White et al.

[11] Patent Number: 4,721,876

[45] Date of Patent: Jan. 26, 1988

[54] LIGHT-SOURCE CAPSULE CONTAINMENT DEVICE AND LAMP EMPLOYING SUCH DEVICE

[75] Inventors: Philip J. White, Georgetown; Robert S. White, Jr., Beverly; William M. Keeffe, Rockport, all of Mass.

[73] Assignee: GTE Products Corporation, Danvers, Mass.

[21] Appl. No.: 873,292

[22] Filed: Jun. 5, 1986

Related U.S. Application Data

[63] Continuation of Ser. No. 744,645, Jun. 13, 1985, abandoned, which is a continuation of Ser. No. 422,312, Sep. 23, 1982, abandoned.

[51] Int. Cl.[4] ..... H01J 17/28; H01J 61/34

[52] U.S. Cl. ..... 313/25; 313/634

[58] Field of Search ..... 313/25, 315, 573, 634, 313/578–580; 362/186; 220/2.1 R

[56] References Cited

U.S. PATENT DOCUMENTS

| | | | |
|---|---|---|---|
| 314,208 | 3/1885 | White | 313/113 X |
| 3,223,273 | 12/1965 | Thorington | 220/2.1 R |
| 4,281,274 | 7/1981 | Bechard et al. | 313/578 X |
| 4,338,540 | 7/1982 | Sovilla | 313/579 |

*Primary Examiner*—Leo H. Boudreau
*Assistant Examiner*—Sandra L. O'Shea
*Attorney, Agent, or Firm*—Joseph S. Romanow; William H. McNeill

[57] ABSTRACT

A light-source containment device and lamp employing such device; a metal halide arc discharge lamp having a light-transmissive shield enclosing the arc tube and a wire mesh surrounding the shield. In the event the arc tube bursts causing shattering of the shield, the wire mesh substantially restricts shards of the shield and arc tube from shattering the outer envelope of the lamp thereby providing improved safety characteristics of the lamp. A similar containment device encloses the light-source capsule and protects against lamp-containment failures in tungsten halogen lamps.

12 Claims, 5 Drawing Figures

LIGHT-SOURCE CAPSULE CONTAINMENT DEVICE AND LAMP EMPLOYING SUCH DEVICE

This is a continuation of co-pending application Ser. No. 744,645 filed on June 13, 1985, which is a continuation of Ser. No. 422,312, filed on Sept. 23, 1982 now abandoned.

CROSS REFERENCES TO RELATED APPLICATIONS

Ser. No. 422,313 filed Sept. 23, 1982, now abandoned, and U.S. Pat. No. 4,625,140 issued Nov. 25, 1986 to Peter R. Gagnon, being a continuation of Ser. No. 422,311, filed Sept. 23, 1982, now abandoned, all assigned to the assignee of this application contained related subject matter.

TECHNICAL FIELD

This invention relates to light-source capsule containment devices and electric lamps employing such devices.

BACKGROUND ART

There is a small probability that a metal halide lamp or a tungsten halogen lamp will burst during operation of the lamp, hereinafter called a "containment failure" of the lamp. When a lamp containment failure occurs, the sequence of events internal to the lamp is as follows: the arc tube or tungsten halogen capsule bursts causing fragments of glass or shards to be propelled against the outer envelope; these shards shatter the outer envelope of the lamp. The external result is that the lamp bursts. It is this type of lamp failure that is the subject of this disclosure.

The causes of these infrequent lamp failures are varied and unpredictable. There is no known way to eliminate the possibility of such failures. Although occurrence of the failure is rare, nevertheless it could present a safety hazard to a person in the immediate vicinity of a lamp. Where such failures can be anticipated, lamp manufacturers notify users by means of warnings on packages and other descriptive materials and by suggested precautions in specifications. This hazard may be avoided by operating the lamp in a fixture designed to contain such a failure. The requirement that the lamp be operated in a protective fixture is frequently employed in commercial usage. However, this procedural safeguard is less acceptable for consumer usage. For reasons of safety, economy, and convenience in both commercial and consumer usage, it may be desirable to incorporate a reliable containment device as part of the lamp itself.

As used herein, the term "light-source capsule" denotes an arc tube of an arc discharge lamp, a halogen capsule of a tungsten halogen lamp, or any light-emitting capsule within the outer envelope of a lamp where the possibility of a lamp-containment failure exists.

The terms "efficacy" or "luminous efficacy" used herein are a measure expressed in lumens per watt of the total luminous flux emitted by a light source over all wavelengths divided by the power input of the source.

In U.S. Pat. No. 4,281,274, issued July 28, 1981, by Bechard et al, there is disclosed an enclosure of glass surrounding the arc tube within the outer envelope of an arc discharge lamp. The enclosure is suggested as being useful as a means to protect against a containment failure of the lamp. While such enclosure may be effective in containing some arc tube bursts, it has been found that in a substantial percentage of cases the enclosure itself is shattered by the burst and containment failure of the lamp follows. Thus, the glass enclosure device taught in the Bechard et al patent offers only limited protection against lamp-containment failures, and such protection is especially tenuous in lamps having light-source capsules in which operating pressures may be as high as 20 or 30 atmospheres.

DISCLOSURE OF THE INVENTION

It is, therefore, an object of this invention to obviate the deficiencies in the prior art.

It is another object of this invention to improve the operating safety characteristics of arc discharge lamps.

Another object of this invention is to improve the operating safety characteristics of tungsten halogen lamps.

These objects are accomplished, in one aspect of the invention, by the provision of a light-source capsule containment device comprising a shield, containment means, and mounting means. The shield has a light-transmissive body enclosing a cavity. The body of the shield has at least one opening in it. The containment means substantially contains shards of the shield. The containment means has a minimal effect on the transmissiveness of the shield. The mounting means provides for mounting the containment means operatively with respect to the shield.

These objects are further accomplished, in another aspect of the invention, by the provision of a lamp having a light-source capsule containment device. Such lamp comprises an outer envelope, a light-source capsule, a stem, a shield, containment means, and mounting means. The light-source capsule is mounted on the stem within the outer envelope. The shield has a light-transmissive body which encloses a cavity. The body of the shield has at least one opening in it. The shield is mounted such that the light-source capsule is substantially contained within the cavity of the shield. The containment means substantially restricts shards of the shield and shards of the light-source capsule from colliding with and shattering the outer envelope in the event the light-source capsule bursts and causes the shattering of the shield. The containment means preferably has a minimal effect on the efficacy of the lamp. The mounting means provides for operatively mounting the containment means with respect to the shield.

Lamps with light-source capsule containment devices constructed in accordance with the foregoing description will exhibit substantially improved operating safety characteristics when compared to lamps of the prior art.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
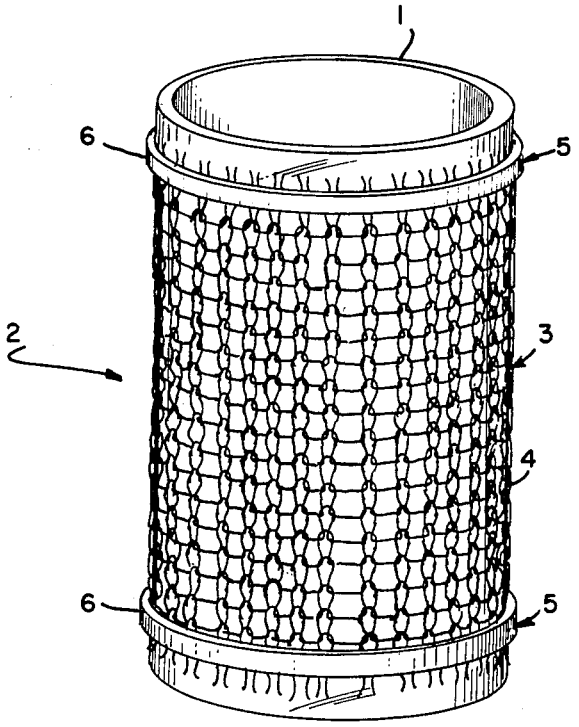
FIG. 1 is a perspective view of one embodiment of a light-source capsule containment device.

Referring to the drawings with greater particularity, FIG. 1 shows a light-source capsule containment device 2 comprising shield 1, containment means 3, and mounting means 5. Shield 1 is a light-transmissive cylinder. Containment means 3 is a loosely woven wire mesh 4 which is wrapped around and substantially surrounds shield 1. Mesh 4 may be sewn or constructed such that the mesh forms a continuous cylinder around the exterior of shield 1. Mounting means 5 comprises two metal straps 6 which secure mesh 4 to shield 1. Metal straps 6 may be bound by appropriate means, such as welding or clamping.

Figure 2:
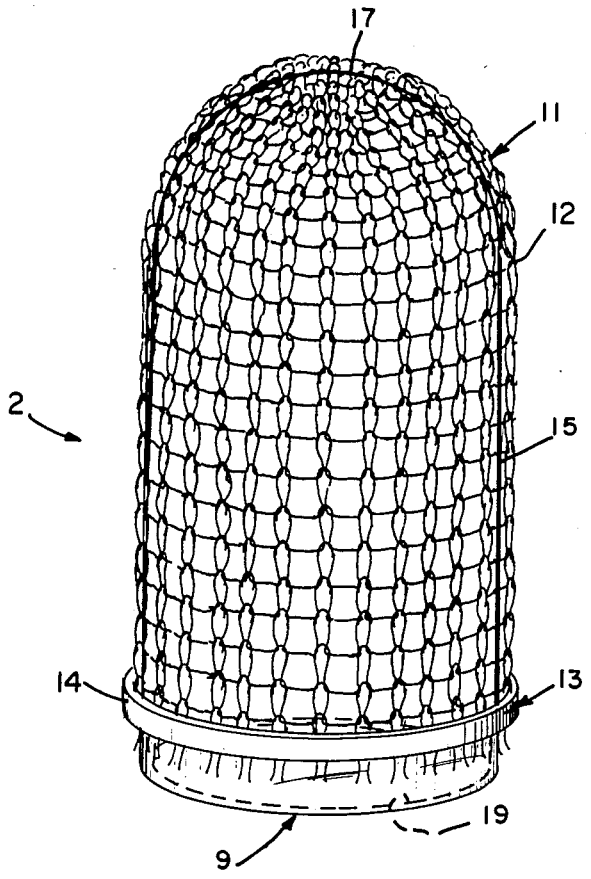
FIG. 2 is a perspective view of a second embodiment of a light-source capsule containment device.

FIG. 2 shows an alternate embodiment of light-source capsule containment device 2 comprising shield 9, containment means 11, and mounting means 13. Shield 9 comprises light-transmissive cylinder 15 and dome 17 fused into a single light-transmissive body. There is a circular opening 19 at the base of shield 9. Containment means 11 is a loosely-woven wire mesh 12 which surrounds shield 9 laterally and about dome 17. Mesh 12 may be sewn or constructed such that the mesh forms a continuous enclosure around the exterior of shield 9 everywhere except in the vicinity of opening 19. Mounting means 13 comprises a metal strap 14. Mesh 12 may be securely mounted to shield 9 with strap 14. Strap 14 may be bound by appropriate means, such as welding or clamping.

Figure 3:
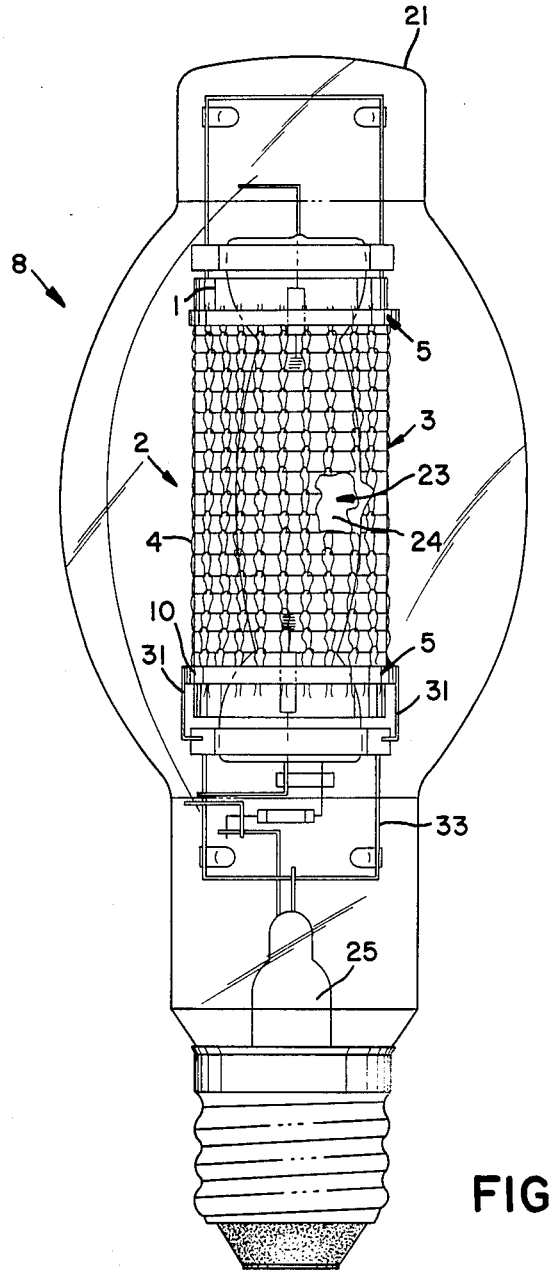
FIG. 3 is an elevational view of an arc discharge lamp employing an embodiment of the invention.

FIG. 3 shows a lamp 8 with light-source containment device 2. Lamp 8 comprises outer envelope 21, light-source capsule 23, stem 25, shield 1, containment means 3, and mounting means 5. In the embodiment of FIG. 3, lamp 8 is an arc discharge lamp and light-source capsule 23 is a double-ended arc tube 24. Containment device 2, comprising shield 1, containment means 3, and mounting means 5, is the identical embodiment shown in FIG. 1 above. Containment device 2 is mechanically mounted within outer envelope 21 to lamp mount 33 by means of support wires 31 such that containment device 2 substantially surrounds arc tube 24 laterally. Strap 10, being the closer of the two straps of mounting means 5 to lamp mount 33, is rigidly fastened to support wires 31. Support wires 31 are rigidly fastened to lamp mount 33. Lamp mount 33 is mounted on stem 25. Rigid mechanical fastening may be accomplished by welding, clamping, or other suitable means.

In the event arc tube 24 bursts, shield 1 will absorb a substantial portion of the shards and energy emanating from such burst. Frequently, shield 1 will be shattered by the effects of the burst. At this point, mesh 4 is critical. Mesh 4 will substantially restrict shards of shield 1 and shards of arc tube 24 from shattering outer envelope 21. Thus, the protection against the possibility of a lamp-containment failure has been significantly improved.

Figure 4:
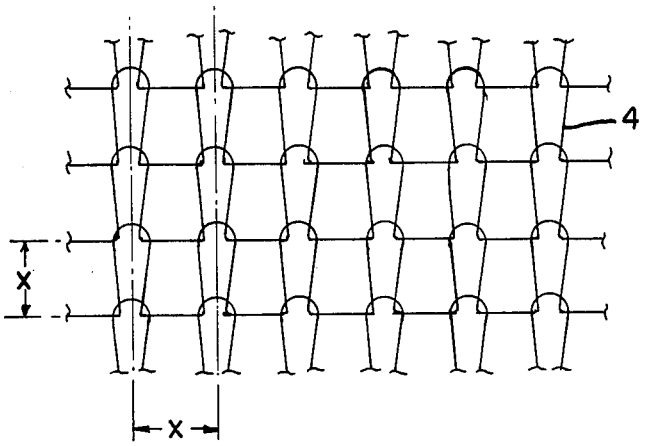
FIG. 4 is an enlarged partial view of one embodiment of containment means.

FIG. 4 shows an enlarged partial view of mesh 4. The stitching of the mesh is approximately square. As shown in the diagram, distance x is size of the stitch.

Figure 5:
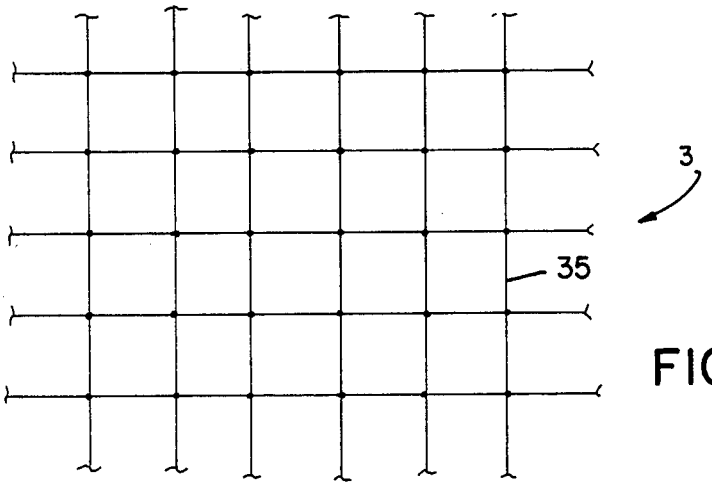
FIG. 5 is an enlarged partial view of an alternate embodiment of containment means.

FIG. 5 shows an enlarged partial view of another embodiment of containment means 3 comprising a rigid mesh 35. This type of mesh or screen is well known.

In the embodiments of the invention shown in FIGS. 1, 2, and 3, the containment means is exterior to the shield. There are other embodiments where the containment means may be imbedded in the shield.

In some embodiments, the containment means is a loosely woven wire mesh. In other embodiments, the containment means may be a rigid mesh. In some embodiments, the loosely woven mesh may be preferred because of its superior energy-containing capability. In other embodiments, the rigid mesh may be preferred because of its tractability or greater transmissiveness.

It is desirable that the mesh be highly transmissive of visible light so that there will be a minimal effect on the efficacy of the lamp. A certain percentage of light will be reflected by the mesh on the light's first pass through the shield. A portion of the reflected light will be unobstructed by the mesh on the reflected light's subsequent pass or passes through the shield. Thus, the net reduction in luminous efficacy is less than would be expected by estimating the percentage of the area of the shield covered by the mesh. In all observed cases, efficacy was reduced by less than 5% due to the presence of the mesh. Because of the partial diffusion caused by the mesh, lamps with mesh-containment devices tend to have less glare.

The selection of construction materials for the shield and containment means is heavily influenced by the environment within the outer envelope during operation of the lamp and immediately following a burst of the light-source capsule. During lamp operation, the ambient temperature about the shield and contaiment means may be in excess of 300° C. Upon the burst of the light-source capsule, the ambient pressure about the shield and containment means may be in the neighborhood of 30 atmospheres. Because of their excellent high-temperature properties and transmissiveness, quartz, fused silica, Pyrex, and hard glass would be suitable materials for the construction of the shield. Stainless-steel wire with a high chromium content is a preferred material for the construction of the containment mesh and mounting strap or straps because of its superior high-temperature properties, relatively low coefficient of thermal expansion, good resistance to oxidation and corrosion, and high tensile strength.

In embodiments employing a containment mesh, the mesh size, i.e., the number of stitches per inch, should be selected such that the mesh will contain shards with mass large enough to be likely to cause a rupture of the outer envelope in the event of a burst of the light-source capsule. Thus, the selection of mesh size is dependent on many factors, such as the type of lamp, the properties of the light-source capsule, the atmosphere within the capsule, the type of mesh, the diameter and tensile strength of the wire in the mesh, etc.

In FIG. 3, there is shown an arc discharge lamp having a double-ended arc tube and a cylindrical containment device. There are equally feasible embodiments where arc discharge lamps with double-ended arc tubes employ domed containment devices like the device shown in FIG. 2. There are also feasible embodiments where arc discharge lamps with single-ended arc tubes employ domed containment devices. All of the benefits and variations of embodiments that have been disclosed with respect to arc discharge lamps apply with equal effectiveness and validity to tungsten halogen lamps and more generally to any electric lamps having a light-source capsule within an outer envelope where the possibility of lamp-containment failure exists.

Several example lamps were constructed. Each lamp employed a quartz shield. The containment means was a loosely woven wire mesh surrounding the shield. Mesh sizes ranged from 8 to 20 stitches per inch. The mesh was constructed of stainless-steel wire having a diameter of approximately 0.005 inches. The mounting means comprised one or two stainless-steel straps.

In some embodiments of the invention, the mounting means for securing the containment means to the shield may be inherent in the shield or containment means. One example is an embodiment wherein the containment means is imbedded in the shield. Another example is an embodiment wherein the containment means is secured to the shield by means of elastic or adhesive forces exerted by the containment means itself.

Thus, there is provided a light-source capsule containment device and a lamp employing such a device which provide substantially improved operational safety characteristics.

While there have been shown and described what are at present considered to be the preferred embodiments of the invention, it will be apparent to those skilled in the art that various changes and modifications can be made herein without departing from the scope of the invention as defined by the appended claims.

We claim:

1. A double-enveloped arc discharge lamp comprising:

(a) an outer envelope;

(b) an arc tube mounted within said outer envelope, said arc tube being subject to burst on rare occasions;

(c) a light-transmissive shield mounted within said outer envelope and substantially surrounding said arc tube, said shield being subject to being shattered by a burst of said arc tube;

(d) containment means substantially surrounding said shield, said containment means being capable of containing shards with mass large enough to be likely to cause a rupture of the outer envelope, said containment means being capable of withstanding a temperature of approximately 300° C. and a pressure of approximately 30 atmospheres, said containment means being imbedded in the body of said shield; and (e) means for structurally and electrically completing said lamp.

2. A double-enveloped arc discharge lamp comprising:

(a) an outer envelope;

(b) an arc tube mounted within said outer envelope, said arc tube being subject to burst on rare occasions;

(c) a light-transmissive shield mounted within said outer envelope and substantially surrounding said arc tube, said shield being subject to being shattered by a burst of said arc tube;

(d) containment means mounted within said outer envelope and substantially surrounding said shield, said containment means being capable of containing shards with mass large enough to be likely to cause a rupture of the outer envelope, said containment means being capable of withstanding a temperature of approximately 300° C. and a pressure of approximately 30 atmsopheres;

(e) means for structurally and electrically completing said lamp;

(f) said containment means being a mesh formed from light-reflecting metal wire;

(g) the diameter of said metal wire being approximately 0.005 inches or greater;

(h) the size of said mesh ranging between eight and twenty stitches per inch inclusive; and (i) the luminous efficacy of said lamp is reduced by less than five percent because of the presence of said mesh.

3. A lamp as described in claim 2 wherein said shield has an elongated cylindrical body with a dome at one end an opening at the other end.

4. A lamp as described in claim 2 wherein said shield has an elongated cylindrical body with openings at both ends.

5. A lamp as described in claim 2 wherein said mesh is loosely woven.

6. A lamp as described in claim 2 wherein said loosely woven mesh is mounted on said shield by means of elastic and adhesive forces exerted on said shield by said mesh itself.

7. A lamp as described in claim 2 wherein said shield is formed from quartz glass.

8. A lamp as described in claim 2 wherein said light-reflecting metal wire is stainless steel.

9. A lamp as described in claim 2 wherein said arc tube is single-ended.

10. A lamp as described in claim 2 wherein said arc tube is double-ended.

11. A lamp as described in claim 2 wherein said lamp is a metal-halide arc dicharge lamp.

12. A lamp as described in claim 2 wherein said lamp is a high-pressure sodium arc discharge lamp.

* * * * *